US009694261B2

(12) United States Patent
Nunez et al.

(10) Patent No.: US 9,694,261 B2
(45) Date of Patent: Jul. 4, 2017

(54) GOLF CLUB HEAD WITH ADJUSTABLE CENTER OF GRAVITY

(71) Applicant: Callaway Golf Company, Carlsbad, CA (US)

(72) Inventors: Christopher A. G. Nunez, Escondido, CA (US); Larry Tang, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/263,598

(22) Filed: Sep. 13, 2016

(65) Prior Publication Data

US 2016/0375326 A1 Dec. 29, 2016

Related U.S. Application Data

(63) Continuation-in-part of application No. 14/932,171, filed on Nov. 4, 2015, now Pat. No. 9,630,069, which is a continuation of application No. 14/163,946, filed on Jan. 24, 2014, now Pat. No. 9,211,453.

(60) Provisional application No. 62/241,360, filed on Oct. 14, 2015, provisional application No. 61/893,728, filed on Oct. 21, 2013.

(51) Int. Cl.

| | |
|---|---|
| ***A63B 53/06*** | (2015.01) |
| ***A63B 53/04*** | (2015.01) |
| ***A63B 60/52*** | (2015.01) |
| ***A63B 60/04*** | (2015.01) |

(52) U.S. Cl.

CPC ..... *A63B 53/06* (2013.01); *A63B 53/0466* (2013.01); *A63B 60/04* (2015.10); *A63B 60/52* (2015.10); *A63B 2053/045* (2013.01); *A63B 2053/0433* (2013.01); *A63B 2053/0437* (2013.01); *A63B 2053/0491* (2013.01); *A63B 2053/0495* (2013.01)

(58) Field of Classification Search

CPC .... A63B 2053/0491; A63B 2053/0433; A63B 2053/0495; A63B 53/0466; A63B 53/06; A63B 60/04

USPC ..... 473/334–339, 341, 342, 344, 345, 348

See application file for complete search history.

(56) References Cited

U.S. PATENT DOCUMENTS

| | | | | |
|---|---|---|---|---|
| 8,192,303 | B2 * | 6/2012 | Ban | A63B 53/0466 473/335 |
| 9,180,349 | B1 * | 11/2015 | Seluga | A63B 53/04 |
| 9,364,728 | B1 * | 6/2016 | Myers | A63B 53/06 |
| 9,387,376 | B1 * | 7/2016 | Hall | A63B 53/06 |

(Continued)

*Primary Examiner* — Benjamin Layno

(74) *Attorney, Agent, or Firm* — Rebecca Hanovice; Michael Catania; Sonia Lari

(57) ABSTRACT

A golf club head comprising features for adjusting the location of the center of gravity along all three axes is disclosed herein. In particular, the head comprises a body with a channel in its sole, at least one slidable receptacle sized to engage the channel, and a slidable weight. The channel preferably comprises a first floor and a pair of rails, while the slidable receptacle comprises a first base portion, a first bolt, and a first upper portion with a slot having a second floor and another pair of rails. The first upper and base portions grip the channel's rails when the first bolt is tightened. Similarly, the slidable weight comprises a second upper portion, a second base portion, and a second bolt, and the second upper and base portions grip the slot's rails when the second bolt is tightened.

20 Claims, 6 Drawing Sheets

(56) References Cited

U.S. PATENT DOCUMENTS

| | | | | |
|---|---|---|---|---|
| 9,623,294 | B1 * | 4/2017 | Kingston | A63B 53/0466 |
| 9,623,302 | B1 * | 4/2017 | Myers | A63B 53/06 |
| 9,630,069 | B2 * | 4/2017 | Foster | A63B 53/06 |
| 9,636,553 | B1 * | 5/2017 | Myers | A63B 53/0466 |
| 2010/0331101 | A1 * | 12/2010 | Sato | A63B 53/0466<br>473/336 |
| 2014/0080628 | A1 * | 3/2014 | Sargent | A63B 53/0466<br>473/336 |
| 2015/0297961 | A1 * | 10/2015 | Voshall | A63B 53/06<br>473/335 |
| 2015/0306473 | A1 * | 10/2015 | Breier | A63B 53/0466<br>473/336 |
| 2015/0321055 | A1 * | 11/2015 | Golden | A63B 53/0466<br>473/338 |
| 2017/0072277 | A1 * | 3/2017 | Mata | A63B 53/06 |

* cited by examiner

GOLF CLUB HEAD WITH ADJUSTABLE CENTER OF GRAVITY

CROSS REFERENCES TO RELATED APPLICATIONS

The present application claims priority to U.S. Provisional Patent Application No. 62/241,360, filed on Oct. 14, 2015, and is a continuation-in-part of U.S. patent application Ser. No. 14/932,171, filed on Nov. 4, 2015, and issued on Apr. 25, 2017 as U.S. Pat. No. 9,630,069, which is a continuation of U.S. patent application Ser. No. 14/163,946, filed on Jan. 24, 2014, and issued on Dec. 15, 2015, as U.S. Pat. No. 9,211,453, which claims priority to U.S. Provisional Patent Application No. 61/893,728, filed on Oct. 21, 2013, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along several channels and several axes.

Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention allows consumers to easily move and fix a weight at any location within several channels disposed in a golf club head in such a way to maximize aesthetic appearances while preserving the function of the movable weight. The objective of this invention is to provide an adjustable weight with minimal or no effect on appearance at address while maximizing the ability of the weight to adjust center of gravity location. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a golf club head comprising a body comprising a crown, a sole, a hosel, a heel side, a toe side, a face, a rear side opposite the face, an edge portion where the crown connects with the sole, and a first channel, a first slidable weight assembly sized to fit within the first channel, the first slidable weight assembly comprising a second channel, and a second slidable weight assembly sized to fit within the second channel.

Another aspect of the present invention is a golf club head comprising a body comprising a crown, a sole, a hosel, a heel side, a toe side, a face, and a rear side opposite the face, a first channel, at least one slidable receptacle sized to fit within the first channel, and a slidable weight, wherein the first channel comprises a first floor and first and second rails extending away from, or parallel to, the first floor, wherein the at least one slidable receptacle comprises a first upper portion having an elongated slot, a first base portion, and a first bolt, wherein the elongated slot comprises a second floor and third and fourth rails extending away from, or parallel to, the second floor, wherein the slidable weight comprises a second upper portion, a second base portion, and a second bolt, wherein the first upper portion and the first base portion reversibly grip the first and second rails when the first bolt is tightened, and wherein the second upper portion and the second base portion reversibly grip the third and fourth rails when the second bolt is tightened. In some embodiments, the sole may be composed of a composite material. In others, the golf club head may be a driver-type club head.

In some embodiments, the first channel may be disposed in the sole and may extend from the toe side to the heel side via the rear side. In still other embodiments, the first channel may be disposed in the sole and may extend linearly in a direction approximately perpendicular to the face. Alternatively, the first channel may extend in a direction approximately parallel to the face. In a further embodiment, the sole may comprise a recessed area, the first channel may be disposed within the recessed area, the slidable receptacle may have a first length, the recessed area may have a second length, and the first length may be no more than 0.10 inch shorter than the second length. In yet another embodiment, the slidable receptacle may comprise an upper surface, which may be approximately flush with the sole when the slidable receptacle is disposed within the first channel.

In other embodiments, each of the slidable receptacle and the weight may comprise one or more metal materials. In some embodiments, the first upper portion may be composed of a first material having a first density, the first base portion may be composed of a second material having a second density, and the first density may be greater than the second density. In other embodiments, the second upper portion may be composed of a third material having a third density, the second base portion may be composed of a fourth material having a fourth density, and the third density may be lower than the fourth density.

In some embodiments, the body may comprise a ribbon between the sole and the crown, and the first channel may be disposed in the ribbon. In other embodiments, the first and second rails may be integrally formed with the first channel, while in an alternative embodiment, the first and second rails may be formed separately from, and be subsequently affixed to, the first channel. In some embodiments, the second upper portion may be composed of a polymer material, and the second base portion may be composed of a tungsten alloy. In a further embodiment, each of the first upper portion and the first base portion may be composed of a steel material. Alternatively, each of the first upper portion and the first base portion may be composed of a plastic material. In yet another embodiment, the golf club head may be a driver-type head, the crown may be composed of a composite material, and each of the face and the sole may be composed of a titanium alloy.

Another aspect of the present invention is a driver-type golf club head comprising a titanium alloy body comprising a sole, a hosel, a heel side, a toe side, a face, and a rear side opposite the face, a carbon composite crown, a first channel, at least one slidable receptacle sized to fit within the first channel, and a slidable weight, wherein the sole comprises a rectangular recessed area, wherein the first channel is disposed within the recessed area and comprises a first floor and first and second rails extending from the first floor, wherein the at least one slidable receptacle comprises a first upper portion having an elongated slot, a first base portion, and a first bolt, wherein the elongated slot comprises a second floor and third and fourth rails extending from the second floor, wherein the slidable weight comprises a second upper portion, a second base portion, and a second bolt, wherein the first upper portion and the first base portion reversibly grip the first and second rails when the first bolt is tightened, wherein the second upper portion and the second base portion reversibly grip the third and fourth rails when the second bolt is tightened, wherein the first upper portion is composed of a first material having a first density, and wherein the first base portion is composed of a second material having a second density that is less than the first density. In some embodiments, the second upper portion may be composed of a third material having a third density, the second base portion may be composed of a fourth material having a fourth density, and the third density may be greater than the fourth density. In a further embodiment, each of the first upper portion and the second upper portion may comprise a tungsten alloy, and each of the first base portion and the second base portion may be composed of a polymer material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the sole of the driver head. Shifting weight along the channels described herein allows for control of center of gravity location along at least two (x and y) axes.

Figure 1:
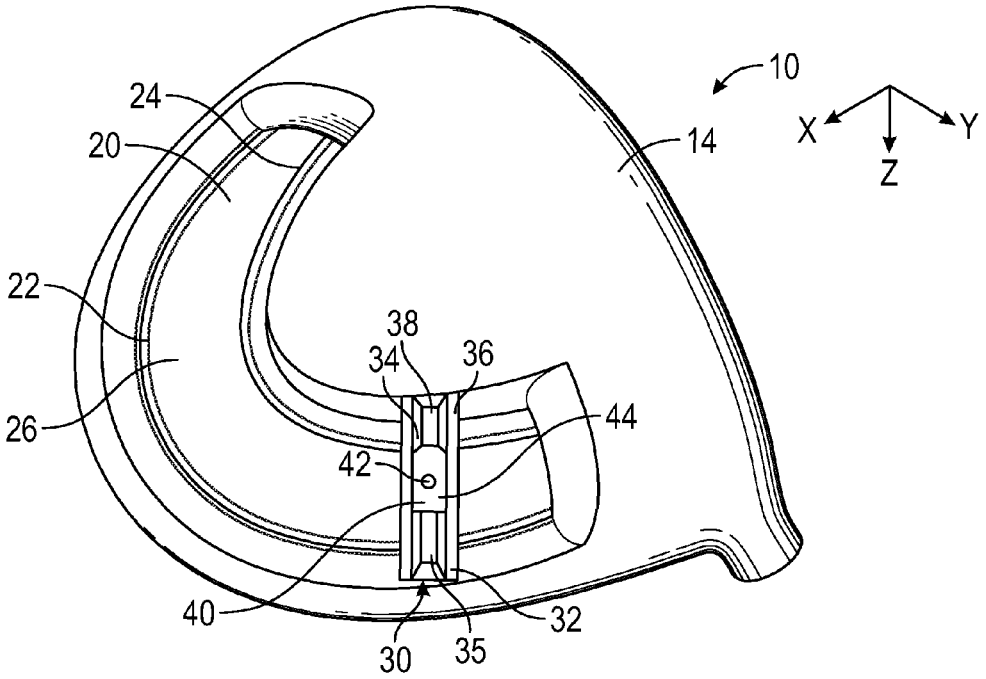
FIG. 1 is a sole elevational view of a first embodiment of the present invention.
Figure 5:
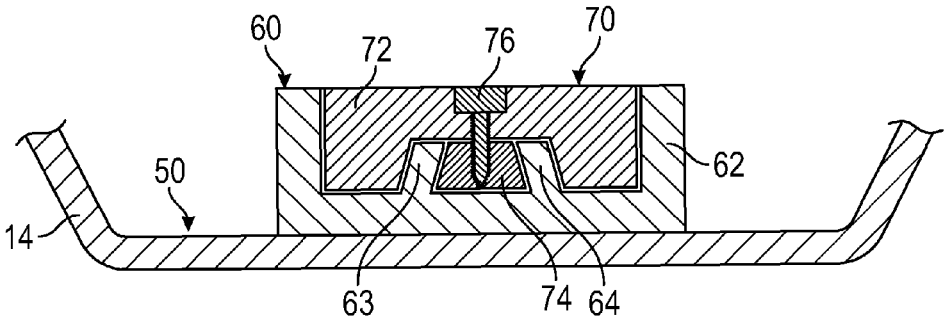
FIG. 5 is a cross-sectional view of the slidable weight shown in FIGS. 2 and 3 along lines 5-5.
Figure 6:
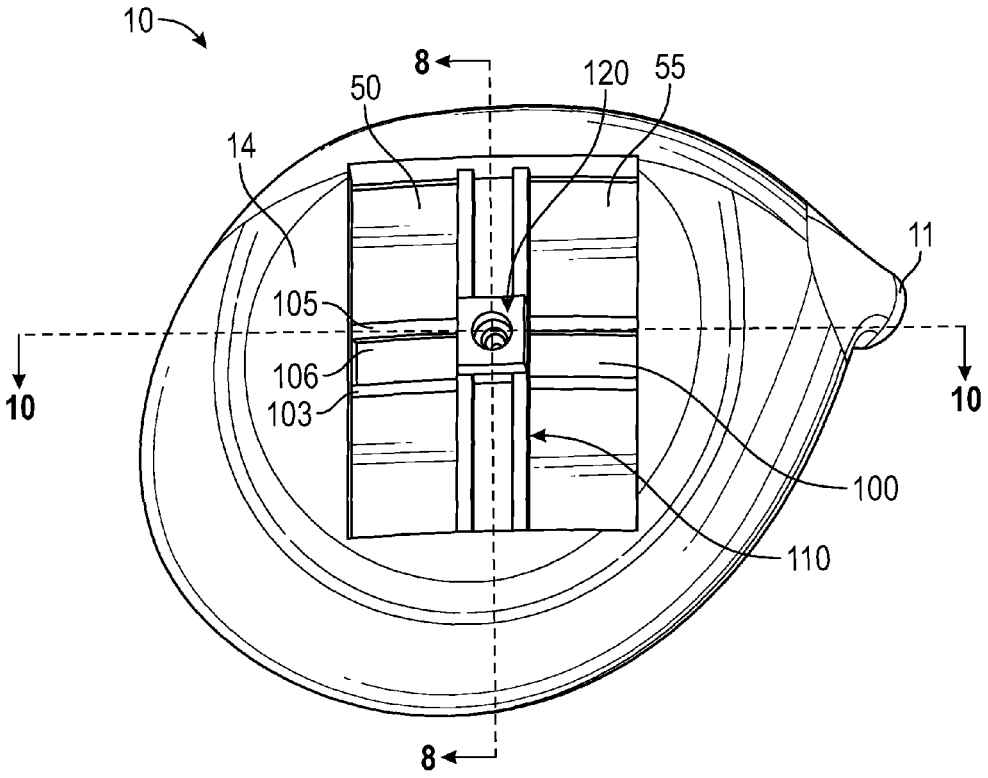
FIG. 6 is a sole plan view of a fourth embodiment of the present invention without any bolts engaged with the slidable weight or weight receptacle.
Figure 7:
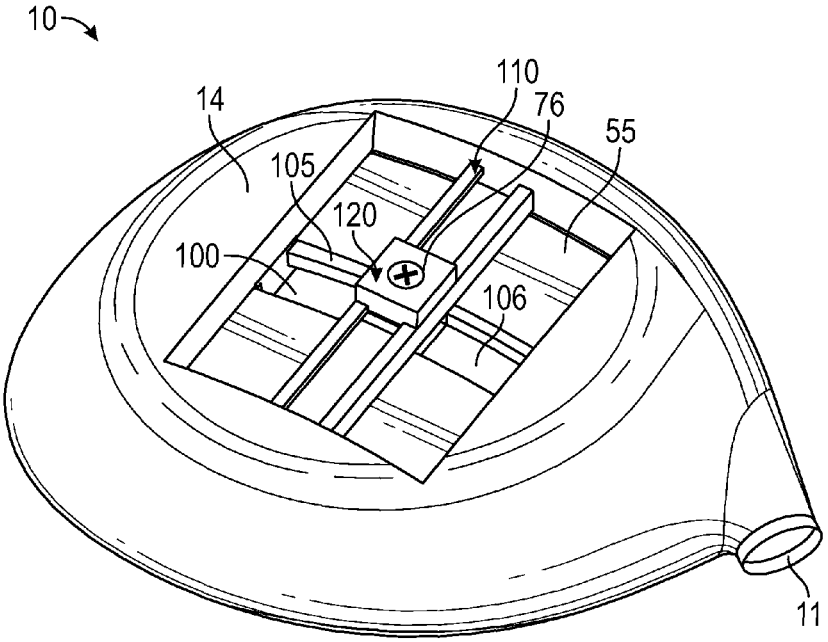
FIG. 7 is a perspective view of the embodiment shown in FIG. 6 with a bolt engaged with the slidable weight.

A first embodiment of the present invention is shown in FIG. 1. The golf club head 10 comprises a channel 20 disposed within the sole 14 of the golf club head, though in alternative embodiments the channel 20 may be disposed in a ribbon or skirt portion or in the crown 12 of the golf club head 10. The channel 20 extends from a heel side 16 of the club head proximate a hosel 11 to a toe side 18 of the golf club head 10 along the rear edge of the sole 14, and has a pair of rails 22, 24 extending upwards from the floor 26 of the channel. A slidable, two-piece cartridge 30 is disposed within the channel 20. The cartridge 30 includes an upper portion 32 with a slot 35 sized to receive a slidable weight 40 and a pair of rails 34, 36 extending from a floor 38 of the slot 35, a nutplate (not shown), and a bolt connecting the upper portion 32 to the nutplate. The upper portion 32 and the nutplate are disposed on either sides of the rails 22, 24, and grip the rails 22, 24 between them when the bolt is tightened, as shown in FIG. 5, which illustrates how the slidable features of the first three embodiments disclosed herein engage with the rails 22, 24 between which they are disposed. Similarly, the slidable weight 40 comprises an upper portion 44, a bolt 42, and a nutplate (not shown), and grips the rails 34, 36 in the cartridge 30 when the bolt is tightened.

Figure 2:
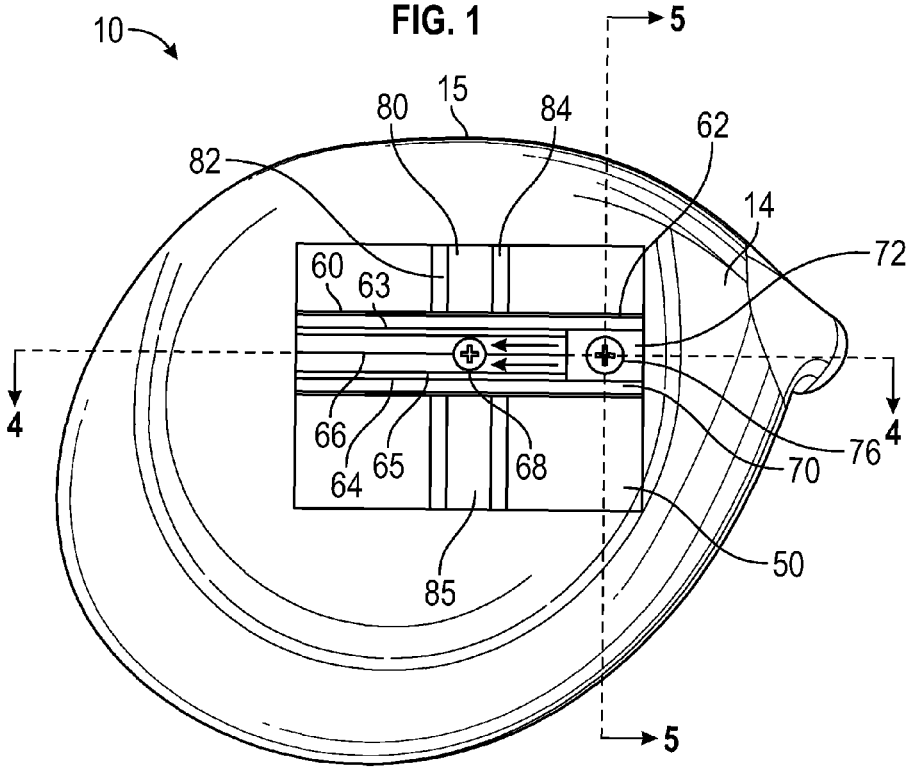
FIG. 2 is a sole plan view of a second embodiment of the present invention.

A second embodiment is shown in FIG. 2. In this embodiment, the golf club head 10 comprises all of the same features as the first embodiment, except that the channel 80 extends perpendicular to the face 15 and is itself disposed, and recessed, within a larger, rectangular recessed area 50 that spans much of the sole 14. The recessed area 50 is sized to receive the upper portion 62 of an elongated weight receptacle 60, while the channel 80 is sized to receive the base portion 61 of the weight receptacle 60, which is connected to the upper portion 62 with a bolt 68. The channel 80 includes a pair of rails 82, 84 that extend upwards or vertically away from the floor 85, and the elongated weight receptacle 60 can be moved, and reversibly fixed, to any location along the channel 80 in the front-to-back (x-axis) direction. Similarly, the upper portion 62 of the weight receptacle 60 comprises an elongated slot 65 with a pair of rails 63, 64 extending upwards from its floor 66, which are sandwiched by the upper and lower portions 72, 74 of a slidable weight 70 when a bolt 76 connecting the upper and lower portions 72, 74 is tightened. The slidable weight 70 can be moved, and reversibly fixed, to any location along the elongated slot 65 in the heel-to-toe (y-axis) direction.

Figure 3:
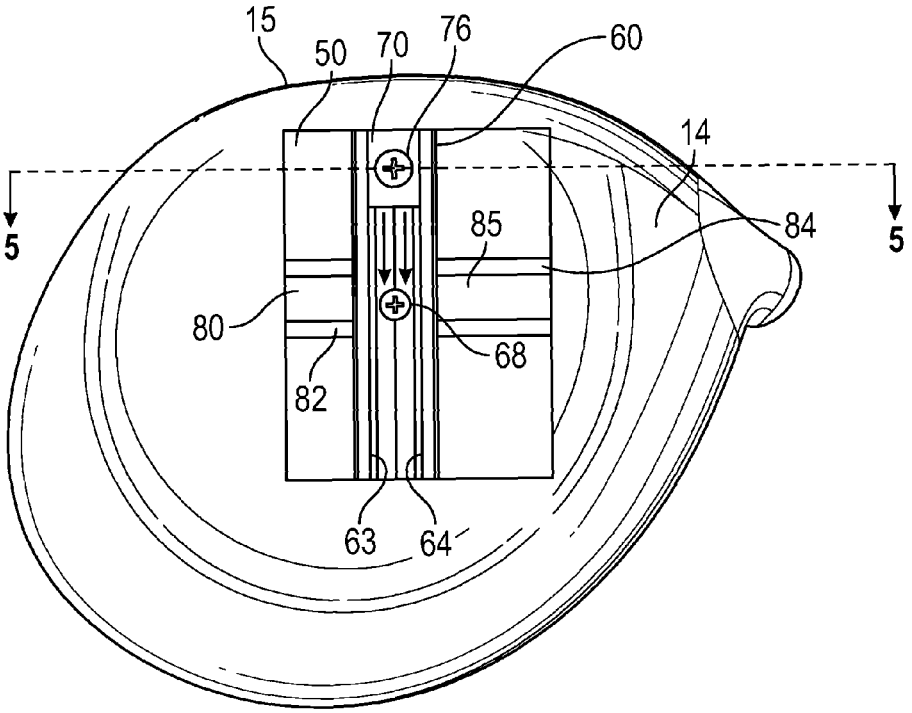
FIG. 3 is a sole plan view of a third embodiment of the present invention.
Figure 4:
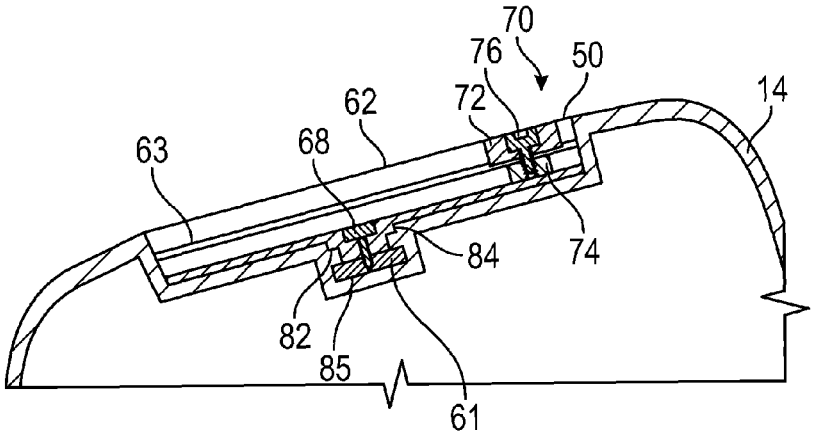
FIG. 4 is a cross-sectional view of the embodiment shown in FIG. 2 along lines 4-4.

A third embodiment is shown in FIG. 3. This embodiment is identical to the second embodiment, except that the channel 80 extends, and is itself recessed, within the rectangular recessed area 50 approximately parallel to the face 15, such that the elongated weight receptacle 60 can be moved, and reversibly fixed, to any location along the channel 80 in the heel-to-toe (y-axis) direction, and the slidable weight 70 can be moved, and reversibly fixed, to any location along the elongated slot 65 in the front-to-back (x-axis) direction.

Figure 8:
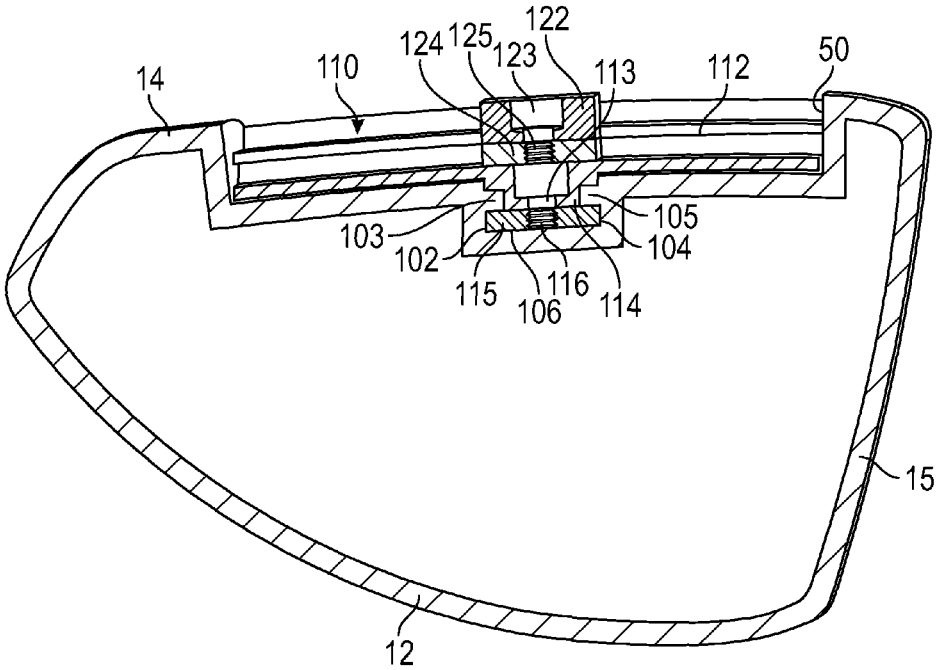
FIG. 8 is a cross-sectional view of the embodiment shown in FIG. 6 along lines 8-8.
Figure 9:
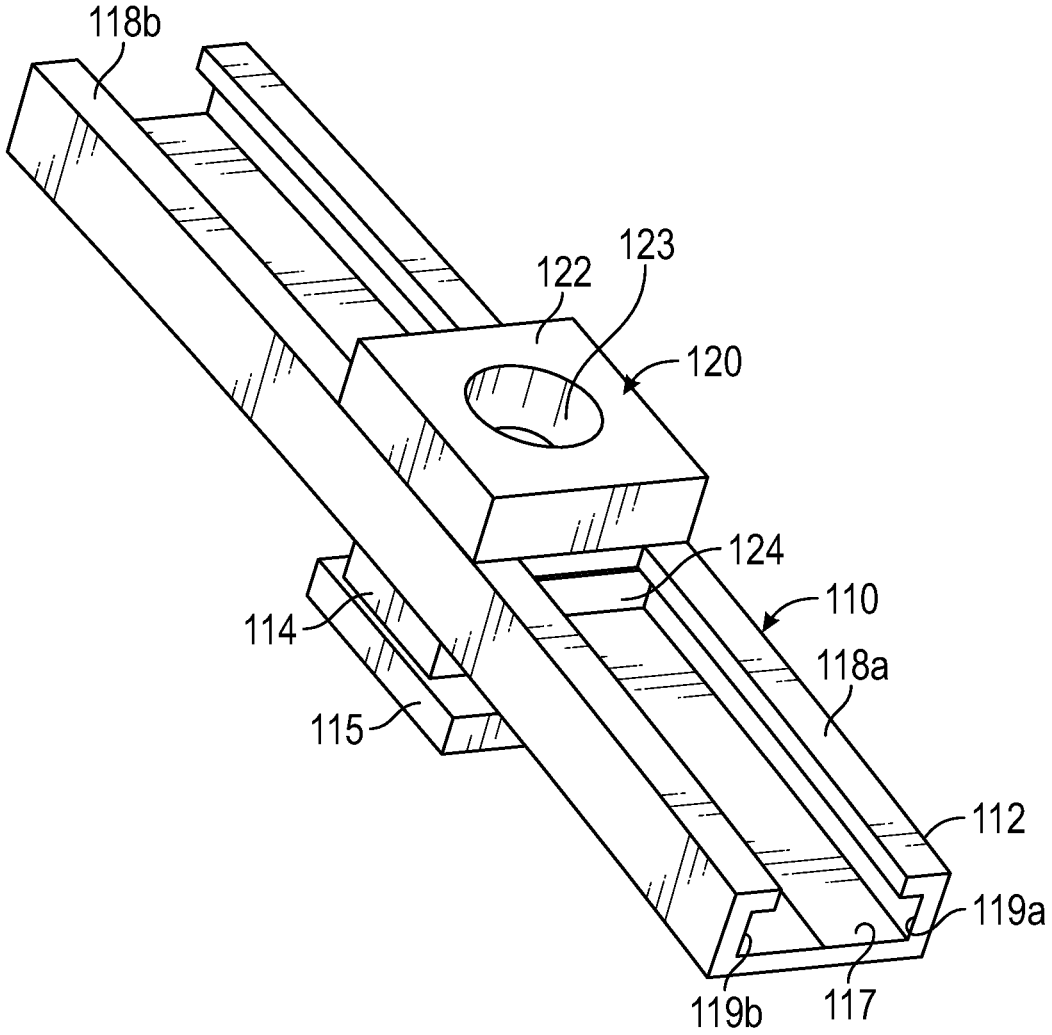
FIG. 9 is a side perspective view of the slidable weight shown in FIG. 6 engaged with the elongated weight receptacle shown in FIG. 6.
Figure 10:
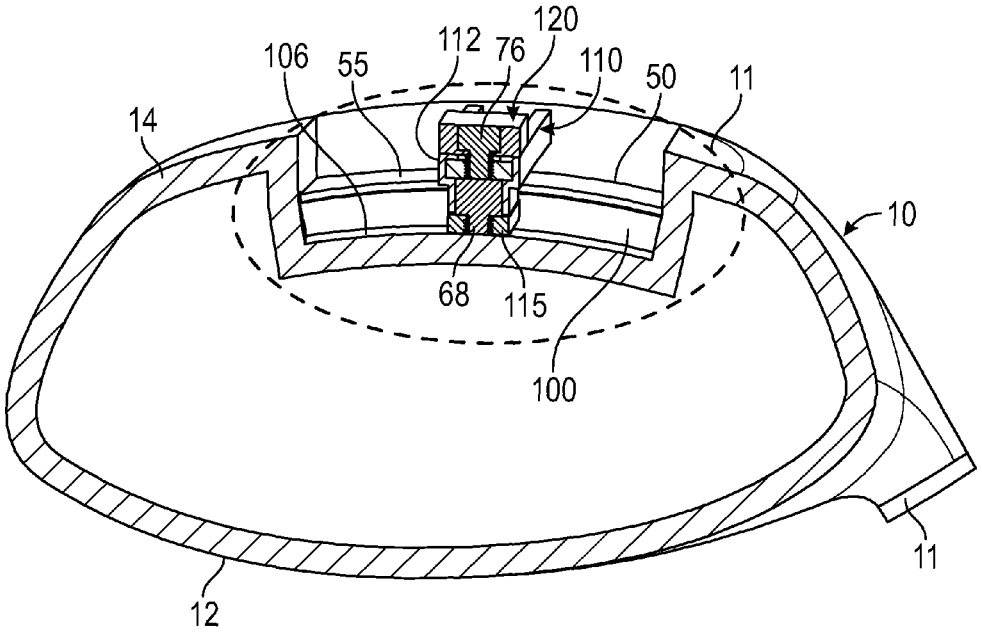
FIG. 10 is a cross-sectional view of the embodiment shown in FIG. 6 along lines 10-10 with bolts engaged with the slidable weight and weight receptacle.
Figure 11:
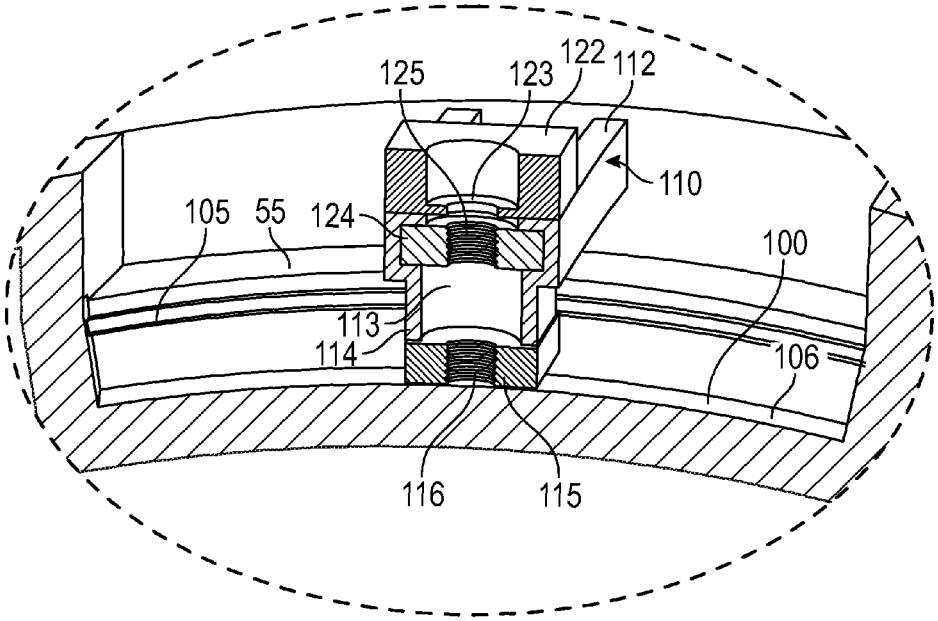
FIG. 11 is an enlarged view of the circled portion of the embodiment in FIG. 10 without any bolts engaged with the slidable weight or weight receptacle.

A fourth, preferred embodiment is shown in FIGS. 6-11. In this embodiment, the golf club head 10 comprises all of the same features as the third embodiment, except that the channel 100 is further recessed into the floor 55 of the rectangular recessed area 50 and comprises a pair of opposing vertical sidewalls 102, 104 from which a pair of rails 103, 105 extend parallel to the floor 106 of the channel 100. The channel 100 is sized to receive the base portion 115 of the elongated weight receptacle 110, which fits between the floor 106 and the rails 103, 105 as shown in FIG. 8. The base portion 115 has a threaded through-bore 116 sized to receive the threaded portion of a bolt 68, and the threaded through-bore 116 aligns with a through bore 113 in a recessed, bolt-receiving portion 114 of the upper portion 112 of the elongated weight receptacle 110. When the bolt 68 is tightened, the base portion 115 and the upper portion 112 clamp onto the rails 103, 105. This configuration allows the elongated weight receptacle 110 to be moved in the heel-to-toe (y-axis) direction and thereby adjust the center of gravity location of the golf club head 10 along that axis.

The upper portion 112 is approximately C-shaped, as it includes a pair of rails 118*a*, 118*b* extending from opposing walls 119*a*, 119*b* parallel to the floor 117 to form an elongated slot 111. As shown in FIGS. 6-11, a slidable weight assembly 120 engages the upper portion 112 of the elongated weight receptacle 110. The slidable weight assembly 120 includes an upper weight portion 122 resting on top of the rails 118*a*, 118*b*, a lower, retaining portion 124 resting on the floor 117 beneath the rails 118*a*, 118*b*, and a bolt 76 that, when tightened, pulls the upper weight portion 122 towards the retaining portion 124 to reversibly clamp onto the rails 118*a*, 118*b*. The bolt 76 extends through a through bore 123 in the upper weight portion 122 and engages a threaded through-bore 125 in the retaining portion 124. Like the elongated weight receptacle 110, this configuration allows the slidable weight assembly 120 to be moved in the front-to-back (x-axis) direction and thereby adjust the center of gravity location of the golf club head 10 along that axis.

In each of the embodiments disclosed herein, the face 15 and sole 14, or entire body, of the golf club head 10 preferably are formed from a metal material, while the crown 12 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

In each of the embodiments herein, the parts of the cartridge 30, the weight receptacle 60, 110, and the slidable weight 70, 120 may be composed of any materials known to a person skilled in the art, and preferably are composed of structurally sound materials such as plastic, composite, and various metal alloys. The vertical (z-axis) center of gravity of the golf club head 10 can be adjusted by altering the materials, and thus the densities, of the various pieces of the weight receptacles 60, 110 and slidable weights 70, 120. For example, if a manufacturer would like to lower the center of gravity of the golf club head 10, it can make one or more portions of the slidable weight assembly 120 from a high density material such as tungsten, and one or more portions of the weight receptacle from a low density material such as plastic or aluminum. Alternatively, if the manufacturer wishes to raise the center of gravity of the golf club head 10, it can make one or more portions of the slidable weight assembly 120 from a low density material and one or more portions of the weight receptacle from a high density material.

In each of the embodiments herein, the channel 20, 100 and elongated slot 65, 111 may comprise features to help align the cartridge 30 and slidable weight 70, 120 respectively, which may include clips, additional rails, and covers.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a crown, a sole, a hosel, a heel side, a toe side, a face, and a rear side opposite the face;

a first channel;

at least one slidable receptacle sized to fit within the first channel; and a slidable weight, wherein the sole comprises a rectangular recessed area, wherein the first channel is disposed within the recessed area and comprises a first floor and first and second rails, wherein the at least one slidable receptacle comprises a first upper portion having an elongated slot, a first base portion, and a first bolt, wherein the elongated slot comprises a second floor and third and fourth rails, wherein the slidable weight comprises a second upper portion, a second base portion, and a second bolt, wherein the first upper portion and the first base portion reversibly grip the first and second rails when the first bolt is tightened, and wherein the second upper portion and the second base portion reversibly grip the third and fourth rails when the second bolt is tightened.

2. The golf club head of claim 1, wherein the at least one slidable receptacle has a first length, wherein the recessed area has a second length, and wherein the first length is no more than 0.10 inch shorter than the second length.

3. The golf club head of claim 1, wherein the at least one slidable receptacle comprises an upper surface, and wherein the upper surface is approximately flush with the sole when the slidable receptacle is disposed within the first channel.

4. The golf club head of claim 1, wherein the sole is composed of a composite material.

5. The golf club head of claim 1, wherein the first channel extends linearly in a direction approximately perpendicular to the face.

6. The golf club head of claim 1, wherein the first channel extends linearly in a direction approximately parallel to the face.

7. The golf club head of claim 1, wherein the golf club head is a driver-type head.

8. The golf club head of claim 1, wherein each of the slidable receptacle and the weight comprises one or more metal materials.

9. The golf club head of claim 1, wherein the first upper portion is composed of a first material having a first density, wherein the first base portion is composed of a second material having a second density, and wherein the first density is greater than the second density.

10. The golf club head of claim 1, wherein the second upper portion is composed of a third material having a third density, wherein the second base portion is composed of a fourth material having a fourth density, and wherein the third density is lower than the fourth density.

11. The golf club head of claim 1, wherein the first and second rails extend from the first floor.

12. The golf club head of claim 1, wherein the first and second rails extend parallel to the first floor from first and second sidewalls.

13. The golf club head of claim 1, wherein the third and fourth rails extend from the second floor.

14. The golf club head of claim 1, wherein the third and fourth rails extend parallel to the second floor from first and second sidewalls.

15. The golf club head of claim 1, wherein the first and second rails are integrally formed with the first channel.

16. The golf club head of claim 1, wherein the second upper portion is composed of a polymer material, and wherein the second base portion is composed of a tungsten alloy.

17. The golf club head of claim 1, wherein the golf club head is a driver-type head, wherein the crown is composed of a carbon composite material, and wherein each of the face and the sole is composed of a titanium alloy.

18. A driver-type golf club head comprising:

a titanium alloy body comprising a sole, a hosel, a heel side, a toe side, a face, and a rear side opposite the face;

a carbon composite crown;

a first channel;

at least one slidable receptacle sized to fit within the first channel; and a slidable weight, wherein the sole comprises a rectangular recessed area, wherein the first channel is disposed within the recessed area and comprises a first floor and first and second rails extending from the first floor, wherein the at least one slidable receptacle comprises a first upper portion having an elongated slot, a first base portion, and a first bolt, wherein the elongated slot comprises a second floor and third and fourth rails extending from the second floor, wherein the slidable weight comprises a second upper portion, a second base portion, and a second bolt, wherein the first upper portion and the first base portion reversibly grip the first and second rails when the first bolt is tightened, wherein the second upper portion and the second base portion reversibly grip the third and fourth rails when the second bolt is tightened, wherein the first upper portion is composed of a first material having a first density, and wherein the first base portion is composed of a second material having a second density that is less than the first density.

19. The driver-type golf club head of claim 18, wherein the second upper portion is composed of a third material having a third density, wherein the second base portion is composed of a fourth material having a fourth density, and wherein the third density is greater than the fourth density.

20. The driver-type golf club head of claim 19, wherein each of the first upper portion and the second upper portion comprises a tungsten alloy, and wherein each of the first base portion and the second base portion is composed of a polymer material.

* * * * *